US005077838A

United States Patent [19]

Senser

[11] Patent Number: 5,077,838

[45] Date of Patent: Jan. 7, 1992

[54] CONVERTIBLE OUTERWEAR GARMENT

[76] Inventor: Dane E. Senser, 10303 San Diego Mission Rd. #110B, San Diego, Calif. 92108

[21] Appl. No.: 627,985

[22] Filed: Dec. 17, 1990

[51] Int. Cl.[5] ..... A41D 1/02

[52] U.S. Cl. ..... 2/69; 2/102; 2/108; 2/82; 2/87; 2/84; 2/88; 2/94

[58] Field of Search ..... 2/69, 102, 108, 87, 2/82, 84, 88, 94

[56] References Cited

U.S. PATENT DOCUMENTS

| | | | |
|---|---|---|---|
| 3,389,407 | 6/1968 | Morrison | 2/84 |
| 3,801,986 | 4/1974 | Purdon | 2/69 |
| 4,122,553 | 10/1978 | Pitkanen | 2/102 |
| 4,149,272 | 4/1979 | Maeshima | 2/102 |
| 4,261,059 | 4/1981 | Spitz | 2/108 |
| 4,302,850 | 12/1981 | Maeshima | 2/102 |
| 4,470,155 | 9/1984 | Maeshima | 2/102 |
| 4,554,682 | 11/1985 | Hillquist | 2/102 |
| 4,569,089 | 2/1986 | Nesse | 2/102 |
| 4,864,656 | 9/1989 | Nesse | 2/108 |

FOREIGN PATENT DOCUMENTS

| | | | |
|---|---|---|---|
| 3447184 | 7/1985 | Fed. Rep. of Germany . | |
| 2365933 | 9/1976 | France | 2/94 |
| 2586535 | 3/1987 | France | 2/108 |

*Primary Examiner*—Werner H. Schroeder
*Assistant Examiner*—Glona Hale
*Attorney, Agent, or Firm*—Gregory J. Nelson

[57] ABSTRACT

A convertible, outerwear garment comprising a sleeveless vest with a jacket having sleeves attached to the interior of the vest at a pouch or pocket formed along a lower edge of the jacket. Panels at the sides of the jacket may be joined to the side of the pouch to complete the jacket structure. The jacket may be inserted into a pouch pocket when the vest is worn without the jacket. The jacket may be deployed from the pouch and the jacket sleeves inserted through the side openings in the vest, the jacket mode to provide added protection to the wearer. In this mode, the lower side panels of the jacket are secured at the side of the pouch. Another pocket may be provided in the rear of the vest to receive a rain cape or poncho which may be deployed by the user for additional wet weather protection.

12 Claims, 3 Drawing Sheets

CONVERTIBLE OUTERWEAR GARMENT

The present invention relates to an outerwear garment and more particularly to a convertible, sleeveless vest that can be easily converted for use as a sleeved garment and further which has a protective poncho or cape that can be deployed.

Sleeveless vests are a popular outerwear item and are used in moderately cold weather, particularly where freedom of arm movement is desireable. These garments are often favored by hunters, construction workers and skiers.

The sleeveless vest does not provide adequate protection in cold weather as the user's arms are exposed and cold temperatures can infiltrate the arm hole areas. Accordingly, it is often necessary for the wearer to have an additional garment available in case of colder or inclement weather. Carrying additional garments is often not convenient and thus the user may find himself or herself uncomfortable in a changed weather condition where the vest does not provide adequate protection.

Accordingly, there exists a need for an outerwear garment which may be used as a sleeveless vest or may be selectively used with sleeves when a greater warmth is required.

One such garment is described in U.S. Pat. No. 4,217,663. This particular patent describes an outerwear garment which has a sleeveless vest having a kidney extension flap at its lower back portion. The kidney extension flap has an interior portion which defines a pouch. A jacket having sleeves is connected to the lower portion of the vest adjacent the pouch. The jacket may be inserted into the pouch when the vest is worn in the sleeveless mode without the jacket or the jacket may be withdrawn from the pouch and the jacket sleeves may be inserted through side openings defined by the vest.

While the garment described in this patent provides substantial advantage over the prior art, the garment has certain disadvantages. The present invention represents an improvement over the garment shown in U.S. Pat. No. 4,217,663 in that it eliminates the need for the kidney flap extension which, in some instances, may be objectionable to the wearer as adding unnecessary bulk and also presenting a garment which does not have the appearance of an ordinary vest.

Accordingly, there exists a need for an outerwear garment which may be used as a sleeveless vest or which may be selectively used with sleeves which garment has the appearance of an ordinary vest.

Accordingly, it is an object of the present invention to provide an outerwear garment in the form of a sleeveless vest which may be readily and easily converted to a jacket garment.

Another object of the present invention is to provide an outerwear garment that is light weight and has the appearance of an ordinary vest which may be converted to a jacket.

Another object of the present invention is to provide a vest-like garment from which a drizzler poncho or cape may be deployed for added protection in wet weather.

Briefly, the present invention provides an outerwear garment which has as its main component a sleeveless vest covering the upper body of the wearer. The vest includes a back portion, front portion and opposite side portions. A suitable closure entends in the front portion of the vest. The lower interior of the back portion defines a pouch. A jacket is provided with a lower end being a continuation of the pouch. The jacket covers the body of the user and has a back portion, a front jacket portion and sleeves which when deployed extend through the armhole in the vest. The vest side portions may be selectively connected to opposite side panels of the jacket to complete the jacket when the jacket is deployed. The side panels may be detached from the sides of the pouch when the jacket is to be in the stored position in the rear pouch.

The garment of the present invention also includes a pocket defined in the back of the vest and in which a drizzler cape or poncho is contained and which cape or poncho may be withdrawn and placed over the head and body of the user in the event of rain.

The above and other objects and advantages of the present invention will become more apparent from the following description and claims in which:

Figure 1:
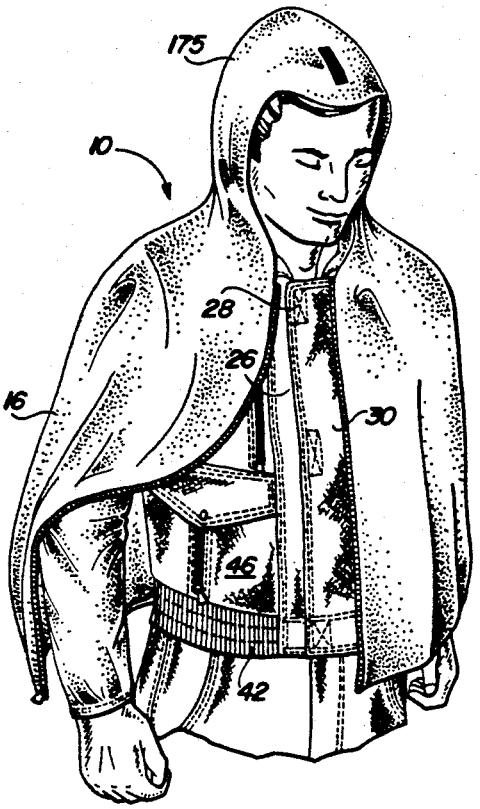
FIG. 1 is a perspective view showing the garment of the present invention on a wearer with the cape deployed.
Figure 2:
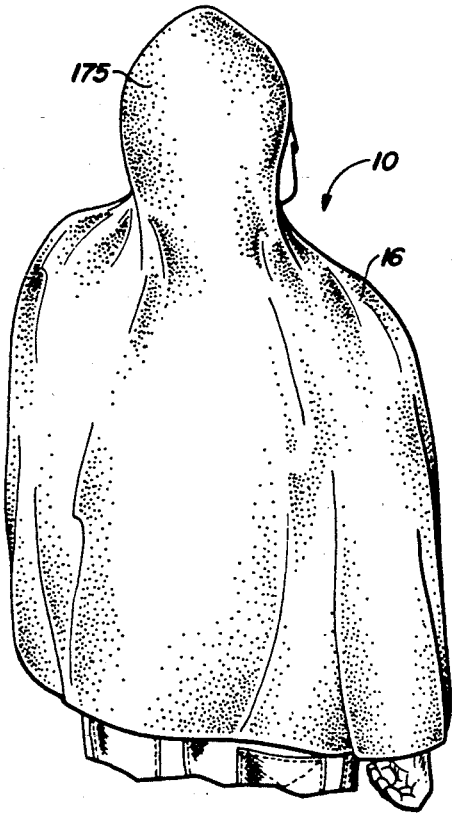
FIG. 2 is a rear view of the garment of the present invention deployed as in FIG. 1.
Figure 3:
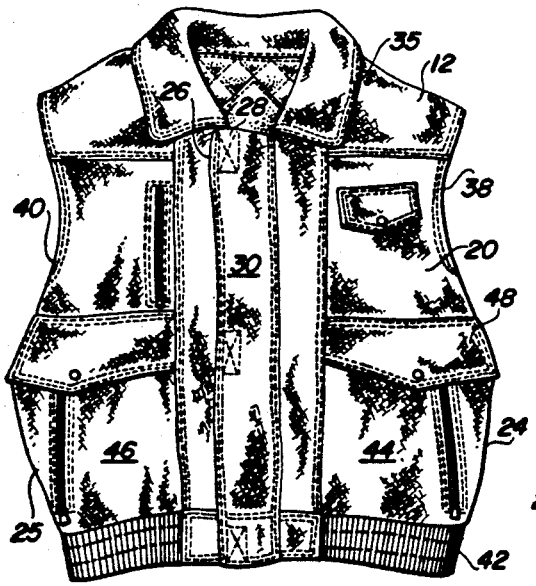
FIG. 3 is a front view of the vest in the closed condition with both the jacket and cape in the stored position.
Figure 4:
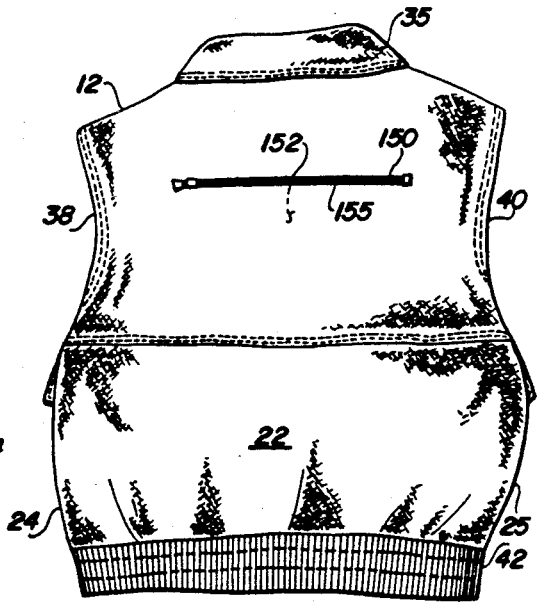
FIG. 4 is a rear view of the vest as shown in FIG. 3.
Figure 5:
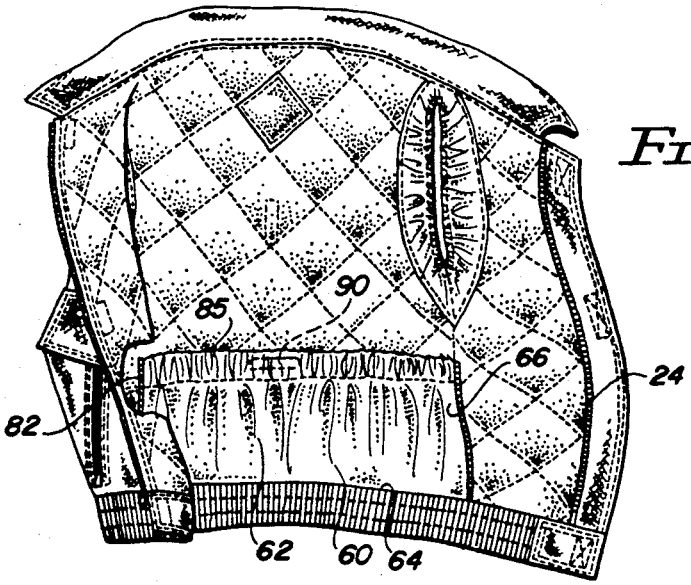
FIG. 5 is a front view of the vest as shown in FIG. 4 with the vest in an open position showing the jacket in a stored position in its pouch.

Referring to the drawings, the garment of the present invention is generally designated by the numeral 10 and includes three components, including a vest 12, jacket 14 and cape or poncho 16. The basic component of the garment is the vest 12 which is best illustrated in FIGS. 3 through 5. The vest includes a front portion 20, a rear portion 22, joined along opposite sides 24 and 25. The front of the vest is bifurcated by opening 26 which is provided with suitable closures 28 shown as a vertically extending flap 30 secured to a left front portion of the vest and securable to the right front portion of the vest by a loop and pile members commonly known as Velcro. The vest is shown having a collar 35 encircling the neck opening the vest. Arm openings 38 and 40 are provided at opposite sides of the vest. The lower circumferential edge of the vest is provided with an elasticized band 42 to snugly encircle and engage the waist area of the wearer. Pockets 44 and 46 are provided on the opposite front portions of the vest, each having a suitable closure flap 48.

The vest may be made of any suitable material such as an outer shell of cotton, nylon or other synthetic, natural material or a blend of these materials. The construction is shown as being stitched and the vest has an inner lining 50 which is best seen in FIG. 5. The lining may be a suitable synthetic or natural material such as cotton or rayon and preferably an insulative material is interposed between the outer shell and the lining. Typical insulative materials for warmth are those such as sold under the tradmeark Fiberfill. The inner lining and the insulative material may be joined by stitching to form a quilted-like structure as seen in FIG. 5.

The construction described above is more or less typical of conventional vests. The present invention provides an improvement over conventional vests in the addition of a jacket 14 which is an integral part of the vest and when not worn by the user is received in the stored condition in pouch 60 formed at the lower interior edge of the vest. The pouch 60 extends transversely along the lower edge of the interior lining 50. Pouch 60 is shown having an outer panel 62 (adjacent the wearer) which is slightly gathered having its lower edge 64 stitched along the lower edge of the jacket at elastic band 42. The panel 62 is an extension of the rear section 100 of the jacket. Similarly, the opposite sides 66 of the pouch are stitched to the jacket at the sides of the jacket at a seam extending vertically from the arm holes. A fastener member shown as one part 81 of a zipper extends vertically along the right side of the pocket as viewed in FIG. 5 which mates with component 81A. Similarly, a zipper having separable components 82 and 82A extends vertically along the left side of the pocket as viewed in FIG. 5. The upper edge of the panel is gathered and elasticized at 85. The upper edge of the panel may be secured to the lining at loop and pile fastener member 90.

As best illustrated in FIGS. 5 to 7 and 11, the jacket 14 may be folded and inserted in the opening 85 which is formed between the panel 62 and the lining 50. When the wearer wishes to utilize the jacket for additional warmth, the jacket may be unfolded by first releasing the closure 90. The jacket 14 may be constructed from any suitable material, natural or synthetic such as nylon or cotton, and has a rear body portion 100 and a front body portions 102 and 103 which are joined by a fastener shown as a zipper 105. Collar 108 extends around the neck area and sleeves 114, 116 are joined to the front and rear body sections in conventional manner.

Figure 11:
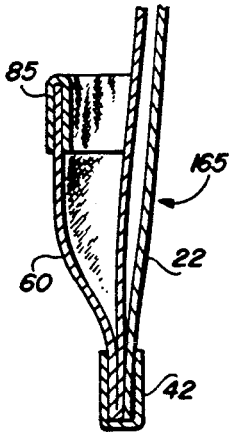
FIG. 11 is a sectional view taken along lines 11—11 of FIG. 6.

As best seen in FIG. 11, the lower edge of the rear body portion 100 of the jacket is attached to or forms an extension of the panel 62 at the elasticized band 85. One side of front 102 of the jacket has a lower section 110 which extends downwardly to a location approximately corresponding to the lower edge elastic band on the jacket. The edge of this section is provided with a mating fastener portion 81A which may be selectively engaged with fastener member 81. Similarly, opposite lower front jacket section 112 extends downwardly at a location approximately corresponding to the elastic band. The edge of this section is provided with a mating fastener member 82A which may be selectively engaged with fastener member 82 at the left side of the pocket as viewed in FIG. 5. Thus, it will be seen, when the jacket is placed within the pocket 60, the fastener members 81, 81A and 82, 82A are disengaged permitting complete folding and insertion of the jacket into the opening 88, as seen in FIG. 11. It will be seen that the rear body portion 100 of the jacket may be pushed down adjacent the interior side of panel 62 which panel forms a pouch with interior lining 50 to receive the remainder of the jacket in a folded condition. Also, the jacket lining 50 is preferably vertically slit at either side of the pocket 60 so the stored jacket may be extended into the area 115 at either side of the pocket for additional storage area. The sleeves, for example, may be inserted in area 115 between the vest rear shell 22 and lining 50.

Figure 6:
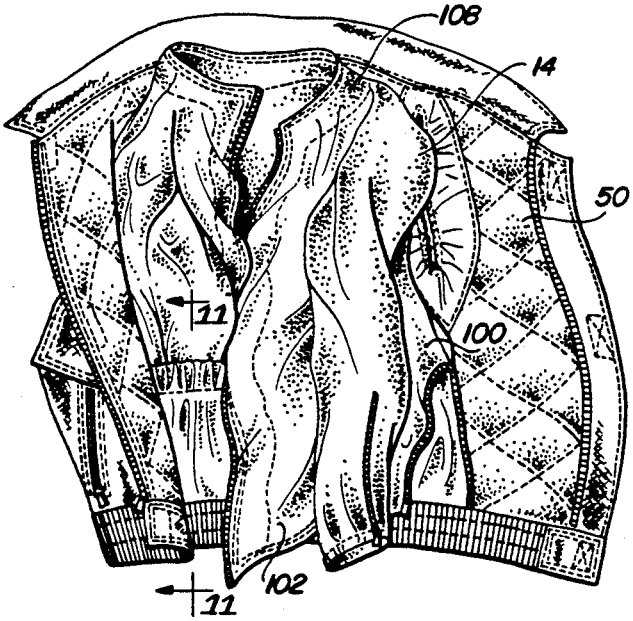
FIG. 6 is a view similar to FIG. 5 with the jacket partially deployed from the pouch.
Figure 7:
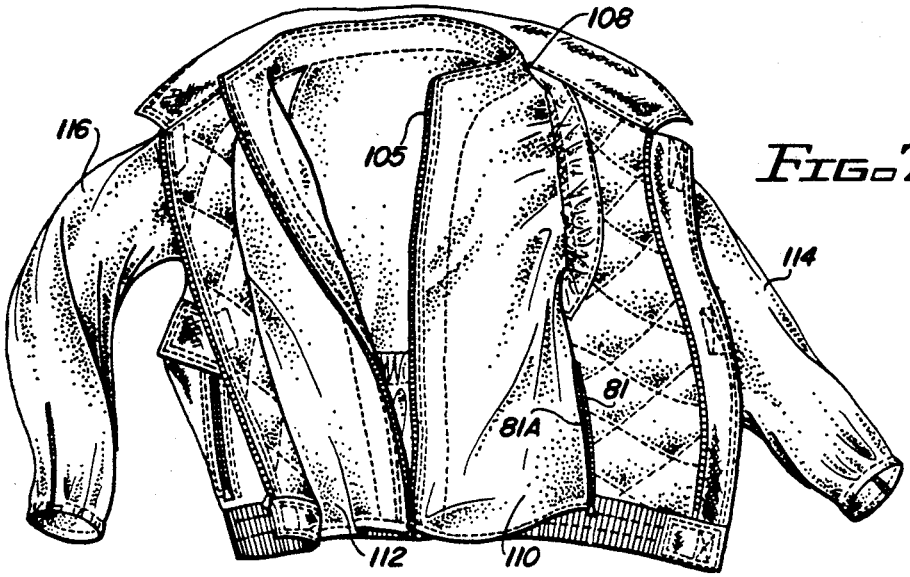
FIG. 7 is a view similar to FIG. 5 with the jacket fully deployed with the jacket arms extending through the armholes in the vest.

When jacket 14 is to be deployed for use, fastener 90 is disengaged at the upper edge of the pouch and the jacket withdrawn as shown in FIG. 6 extending the back portion of the jacket along the interior lining of the vest. The side sections 102, 103 of the jacket will assume a position along the interior of the sides of the vest and the sleeves 114, 116 may be inserted through the armholes in the vest. Fasteners, 81, 81A, 82, and 82, 82A are engaged securing the lower sections 102, 103 of the jacket to the interior of the vest completing the jacket deployment. In this manner, an outerwear garment is provided giving the user extra snugness and insulation for greater warmth. When it is desired to return the jacket to the stored position, the fasteners 81, 81A and 82, 82A are disengaged and the sleeves of the jacket withdrawn from the armholes of the vest. The jacket may be then folded and returned to the pouch at the lower interior edge of the lining. In this way the jacket body corresponds to the body of the vest and the requirement for an extension pouch to receive the folded jacket is eliminated. The vest has the outward appearance of an ordinary vest.

Figure 8:
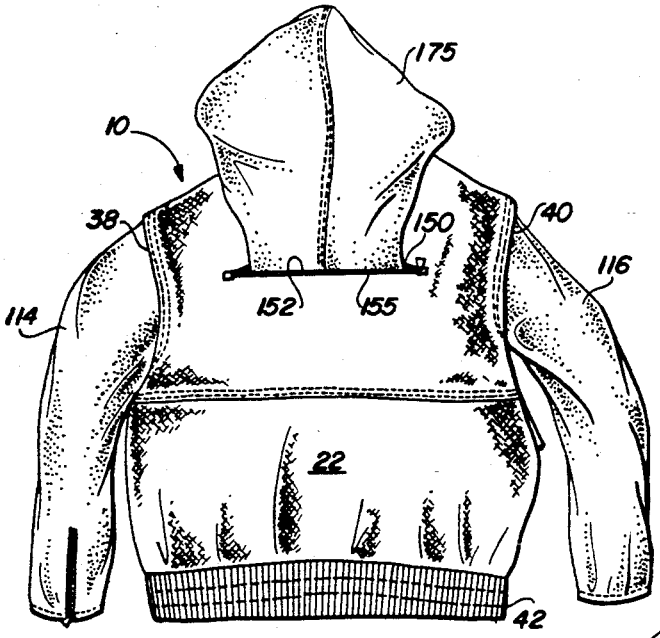
FIG. 8 is a rear view of the garment as shown in FIG. 7 with the poncho hood in position.
Figure 9:
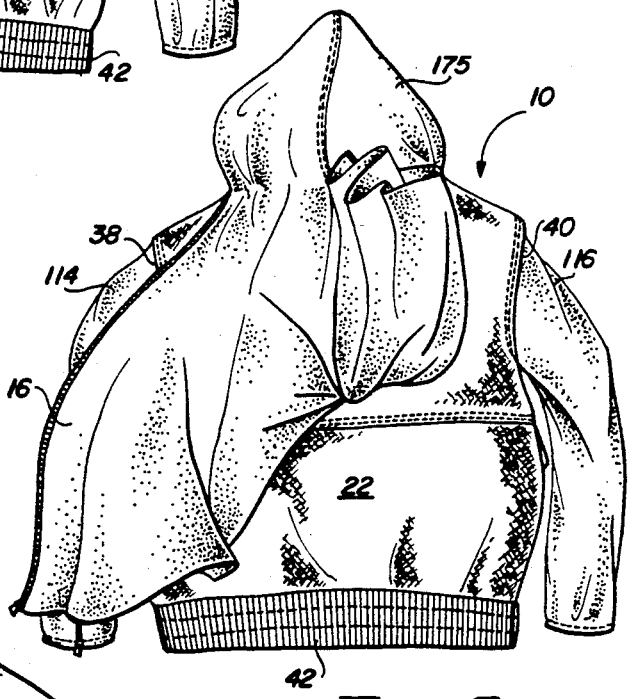
FIG. 9 is a view similar to FIG. 8 with the rain cape or poncho partially deployed.
Figure 10:
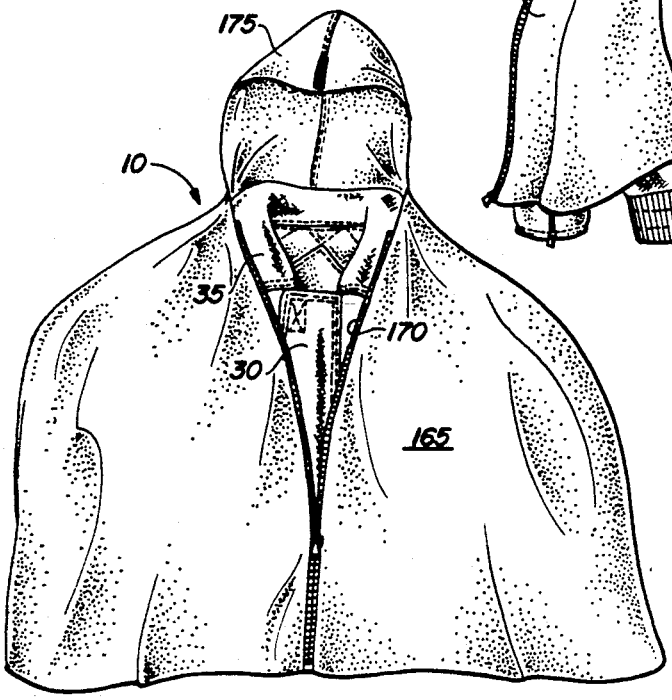
FIG. 10 is a front view of the garment with the rain cape and hood fully deployed.

The garment of the present invention also provides a cape or poncho with a hood which may be deployed as desired. As seen in FIGS. 8 to 10, generally transverse opening 150 is provided in the rear of the vest at a location generally extending between the area occupied by the shoulder blades of the wearer. The opening 150 provides access to a pocket 152 defined by the exterior shell of the vest and the interior lining. The opening 150 is provided with a suitable closure 155 shown as a zipper but may be other type of closure, such as a snap closure or loop and pile fastener closures. A poncho or cape 116 is received in the stored position in the pocket 152. The poncho has a main body 165 adapted to cover the upper torso of the wearer. The cape is provided with a closure 170 extending vertically along the front of the body. The upper end of the cape 16 is provided with a hood 175 which may be placed over the user's head. The poncho is joined to the interior pocket 152 by stitching or a removable fastener at a location at the rear of the poncho below the hood. In the unfolded or deployed position, the poncho may be removed from pocket 152 and extended over the upper body of the user with the hood about the head of the user. Alternatively, the main body of the poncho may remain in the pocket 152 and only the hood removed to provide protection for the head of the user if the user does not wish to utilize the cape-like body of the poncho as seen in FIG. 8.

From the foregoing, it will be seen that the present invention provides a unique, versatile and convertible outerwear garment which may be readily adapted for various weather conditions. Although an illustrative embodiment of the invention has been shown and described, it is understood that various modifications, changes and alterations may be made by those skilled in the art without departing from the spirit and scope of the appended claims.

I claim:

1. A convertible outerwear garment which may be worn as a vest or jacket comprising:

(a) a sleeveless vest having arm openings worn over the upper body of the user, said vest having a back portion and a front portion having closure means for closing the front portion, said front and back portions each having an exterior side and an interior side terminating along a lower edge which extends about the wearer;

(b) a pouch formed at said interior side of the back portion of said vest;

(c) a jacket having a back portion with lower and opposite side edges and opposed front portions at the said opposite side edges of said back portion and a pair of sleeves extending from the jacket;

(d) at least a portion of the lower edge of said back portion of said jacket being attached at said pouch with said front jacket portions positionable at opposite sides of said pouch when said jacket is deployed; and (e) fastener means for selectively securing said front jacket portions at opposite sides of said pouch whereby said jacket may be inserted in said pouch in a stored condition with said fastener means unsecured or the said jacket portion may be deployed from the said pouch and the jacket sleeves inserted through the arm openings and said fastener means secured.

2. The garment of claim 1 wherein said vest has an outer shell, inner lining and insulative material therebetween.

3. The garment of claim 2 wherein said vest inner lining is formed from the fabric group consisting of natural fibers, synthetic fibers or a blend of natural and synthetic fibers.

4. The garment of claim 2 wherein said vest outer shell is formed from the fabric group consisting of natural fibers, synthetic fibers or a blend of natural and synthetic fibers.

5. The garment of claim 1 further including a collar associated with said vest.

6. The garment of claim 1 wherein the lower edge of said jacket is provided with an elasticized band.

7. The garment of claim 1 wherein the upper edge of said pouch is elasticized and further including fastener means for detachably securing said pouch to the interior lining of said jacket.

8. The garment of claim 1 wherein said lower edge of said jacket is attached at the interior edge of said pouch and forming a pocket therebetween for reception of the jacket in a folded condition.

9. The garment of claim 1 further including a second pocket in the back portion of said vest and a cape receivable in said second pocket whereby said cape may be inserted into said second pocket or the said cape may be withdrawn form the said second pocket and deployed over the vest and user for additional protection.

10. The garment of claim 9 wherein said cape has integral hood means.

11. The garment of claim 1 wherein said pouch is formed between the interior of said vest back portion and the jacket back portion.

12. The garment of claim 11 wherein said jacket back portion is attached to said pouch and further including an elasticized member extending transversely of said jacket in the area where said jacket back portion and pouch are attached.

* * * * *